US007465259B2

(12) United States Patent
Mok

(10) Patent No.: US 7,465,259 B2
(45) Date of Patent: Dec. 16, 2008

(54) EXERCISE APPARATUS

(76) Inventor: Harry Mok, 1821 Rail St., Manteca, CA (US) 95337

( * ) Notice: Subject to any disclaimer, the term of this patent is extended or adjusted under 35 U.S.C. 154(b) by 0 days.

(21) Appl. No.: 11/523,293

(22) Filed: Sep. 20, 2006

(65) Prior Publication Data

US 2008/0081747 A1 Apr. 3, 2008

(51) Int. Cl.
*A63B 20/02* (2006.01)

(52) U.S. Cl. ..... 482/126; 482/121

(58) Field of Classification Search ..... 482/121–130; 124/23.1
See application file for complete search history.

(56) References Cited

U.S. PATENT DOCUMENTS 3,256,015 A * 6/1966 Perrin ..... 482/129
3,268,225 A * 8/1966 Kolbel ..... 482/126
3,536,326 A * 10/1970 Yatrides ..... 482/126
3,746,339 A * 7/1973 Cox ..... 482/126
4,057,246 A * 11/1977 Wilson ..... 482/125
4,059,265 A * 11/1977 Wieder et al. ..... 482/125
4,334,678 A * 6/1982 Doyel ..... 482/128
4,373,716 A * 2/1983 Pagani ..... 482/130
4,451,035 A * 5/1984 Manzi ..... 482/126
4,733,861 A * 3/1988 Plunkett, III ..... 482/126
5,125,649 A * 6/1992 Fuller ..... 482/123
6,544,152 B2 * 4/2003 Rosati ..... 482/126
6,770,011 B1 * 8/2004 Hinds ..... 482/44
6,866,617 B2 * 3/2005 Chen ..... 482/124
6,905,448 B1 * 6/2005 Blaker ..... 482/126
6,926,747 B2 * 8/2005 Udwin ..... 48/126
7,041,041 B1 * 5/2006 Evans ..... 482/126
7,090,627 B1 * 8/2006 Walker ..... 482/140
7,141,012 B2 * 11/2006 Lin ..... 482/126
2003/0130099 A1 * 7/2003 Chen ..... 482/126
2004/0127339 A1 * 7/2004 Finn ..... 482/140
2005/0037904 A1 * 2/2005 Chang et al. ..... 482/122
2005/0075223 A1 * 4/2005 Wu ..... 482/126
2005/0079963 A1 * 4/2005 Lin ..... 482/126
2005/0130815 A1 * 6/2005 Abdoli-Eramaki ..... 482/121
2006/0052223 A1 * 3/2006 Terry ..... 482/126
2006/0135329 A1 * 6/2006 Owen ..... 482/123
2006/0160679 A1 * 7/2006 Kung ..... 482/121
2006/0160681 A1 * 7/2006 McBride et al. ..... 482/123
2007/0287617 A1 * 12/2007 Teng ..... 482/126

* cited by examiner

*Primary Examiner*—Lori Amerson

(57) ABSTRACT

An exercise apparatus that is lightweight, easily transported, inexpensive and easy to use in performing a wide variety of exercises, the exercise apparatus including a rigid shaft formed of interconnectable limbs having a pair of spaced sleeve-sliders thereon and opposing end caps that receive a long resilient band having side lengths stretched along the staff and the sleeve-sliders thereon, and with each end cap also receiving a short resilient band with a handle thereon.

22 Claims, 11 Drawing Sheets

EXERCISE APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

This invention relates to exercise apparatus used to develop and maintain muscular strength.

It has long been recognized that various types of exercise apparatus can be used by individuals desiring to increase and maintain muscular strength. Such exercise apparatus may be very simple and comprise dead weights that are lifted with the arms and legs, or large rubber bands that can be stretched to provide resistance, thereby increasing muscular strength.

Dead weights may be as simple as plastic bottles filled with water and with each bottle being individually grasped by a user's hands to be elevated in exercises that will develop muscular strength. The dead weights may also be heavier bar bells that are to be individually lifted by hand, or may comprise a long shaft with one or more weights affixed to each end of the shaft, with the shaft and weights being raised and lowered by a user in the development and maintenance of muscles in various parts of the body.

The large rubber bands, used for exercise purposes, may be stretched using arms, legs and other body parts, with the stretching action of the bands providing resistance that will develop muscular strength, or that will maintain desired strength. The large rubber bands can also be attached to a fixed structure, such as a door knob, or the like, and the user may stretch the attached rubber band to provide resistance and muscular development or maintenance.

A great many exercise machines and apparatus have also been proposed in the past. Such machines and apparatus frequently obtain essential the same results as the basic dead weight lift system and rubber band stretching system. However, the machines and/or apparatus that have been developed are frequently large, bulky and heavy, and must be used in a pre-determined location. Often it is not practical to try and transport the machine or exercise apparatus since it is too bulky, and too heavy.

There remains a need for an effective exercise apparatus that can be easily transported by a user from location to location. A user who is traveling from location to location often needs or desires an exercise apparatus that can be easily and quickly set up for use in a bedroom, a hotel room, or any convenient space and that can be disassembled to be easily carried from location to location.

BRIEF SUMMARY OF THE INVENTION

1. Objects of the Invention

Principal objects of the present invention are to provide an exercise apparatus that is lightweight and compact so that it can be conveniently carried from location to location. It is another object to provide an exercise apparatus that can be readily set up for use, and that will allow the user to perform a wide variety of exercises to achieve development and maintenance of muscular strength of diverse muscles and muscle groups.

Other objects are to provide an exercise apparatus that is inexpensive, as compared to larger, more bulky exercise apparatus.

Still another object is to provide an exercise apparatus that will allow the user to perform many exercises that cannot be performed with more simple exercise apparatus, such as dead weights and large rubber bands.

Yet another object is to provide an exercise apparatus that can easily be used to exercise a wide variety of muscles, even in a limited space, such as a bedroom, or hotel room.

2. Features of the Invention

Principal features of the invention include an elongate staff that is constructed from easily assembled components that are light in weight and easy to assemble.

Other features include at least one long stretch band formed of resilient tubing that is stretched through end pieces fixed to opposite ends of the staff. The long stretch band is formed as an endless band that when fitted to the staff and relaxed has opposite sides lying against the length of the staff and sleeve-sliders mounted on the staff.

Sleeve-sliders slide onto opposite ends of the staff to provide adjustable gripping surfaces on the staff. The sleeve-sliders are movable along the staff to be spaced apart a distance that will allow convenient and comfortable grasping during a performance of many different exercises by a user.

The spaced sleeve-sliders also serve as sliding members and when grasped, together with the adjacent side lengths of the long stretch band, can be moved along the staff towards and away from one another. The sliding movement stretches portions of the long stretch band and provides resistance to strengthen upper body muscles used in performing the movements.

A shorter stretch band formed of resilient tubing is provided at each end of the staff, and the long stretch band and the shorter stretch bands are each secured in and project from caps affixed to opposite ends of the staff.

With the exercise apparatus of the invention, a user may exercise virtually every muscle and each muscle group of the body.

Additional objects and features of the invention will become apparent to persons skilled in the art to which the invention pertains from the following detailed description, drawings and claims.

BRIEF DESCRIPTION OF THE FIGURES OF THE INVENTION

In the Drawings

Figure 3:
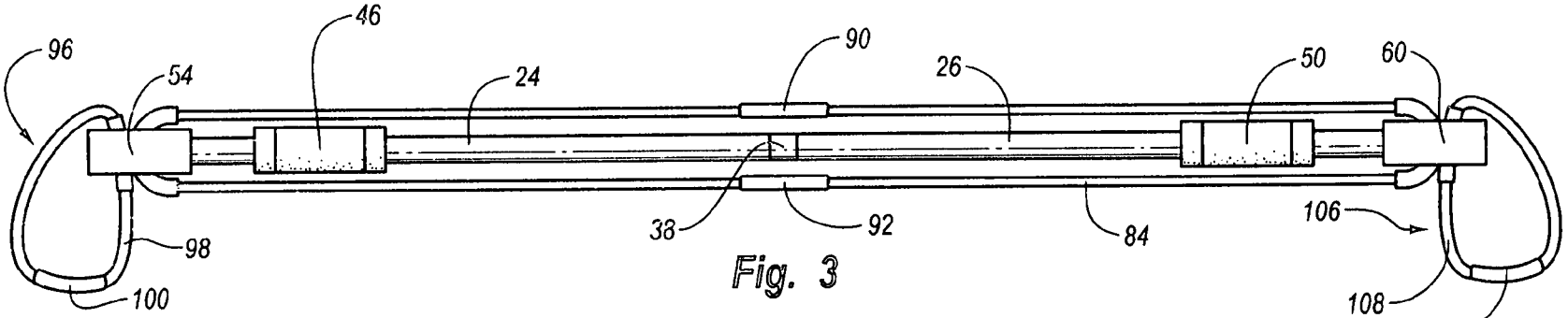
Figure 4:
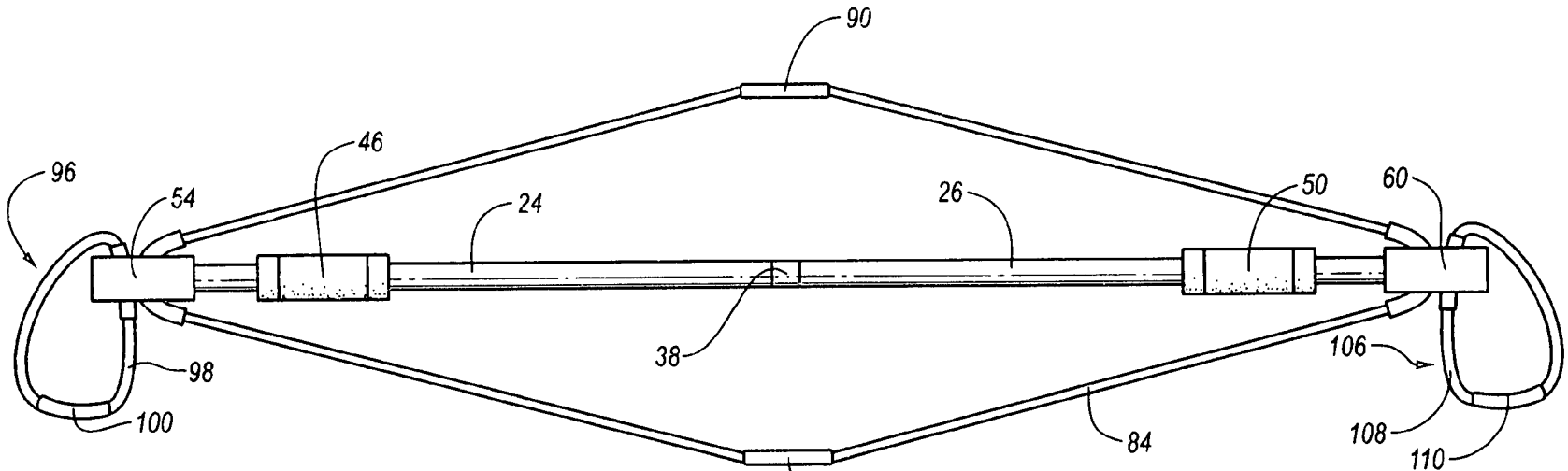
Figure 5:
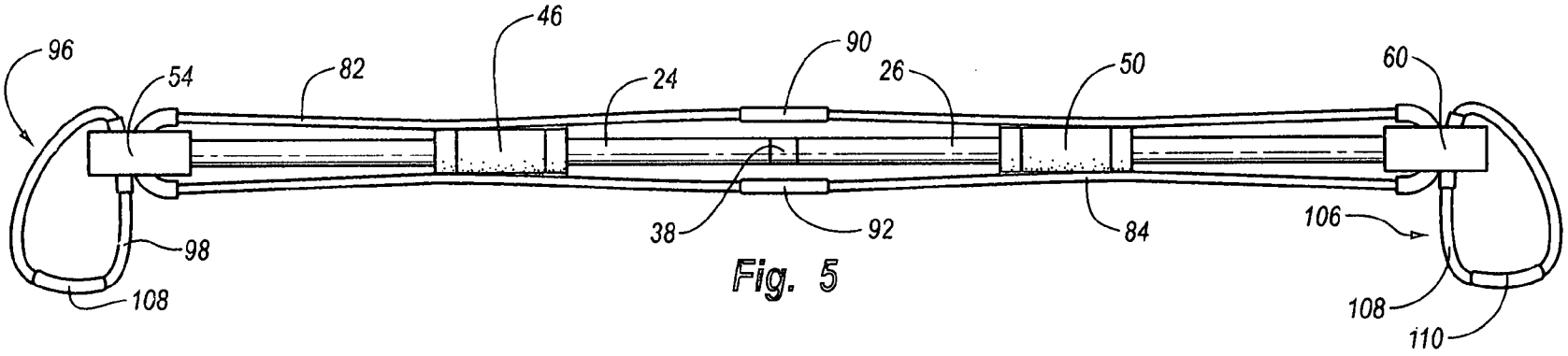
Figure 6:
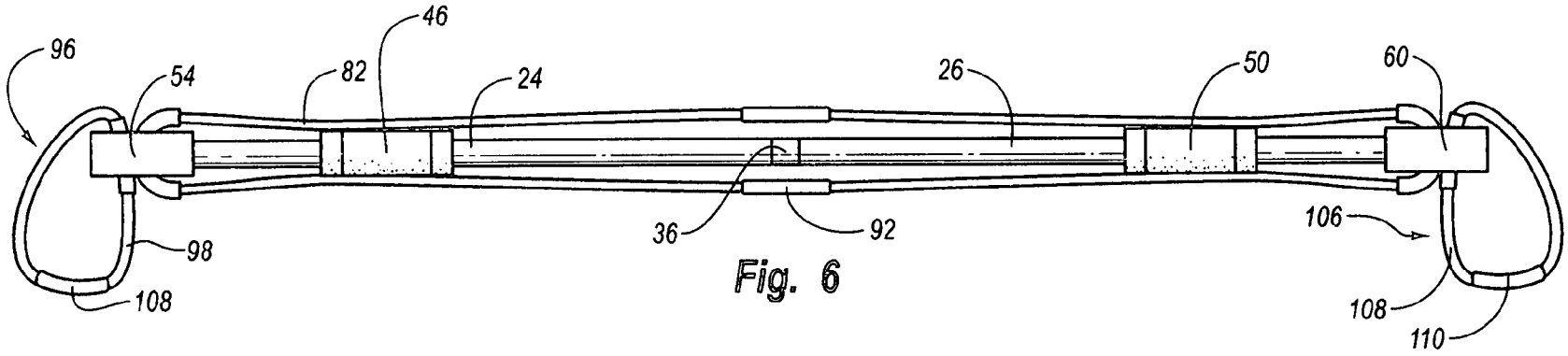
Figure 7:
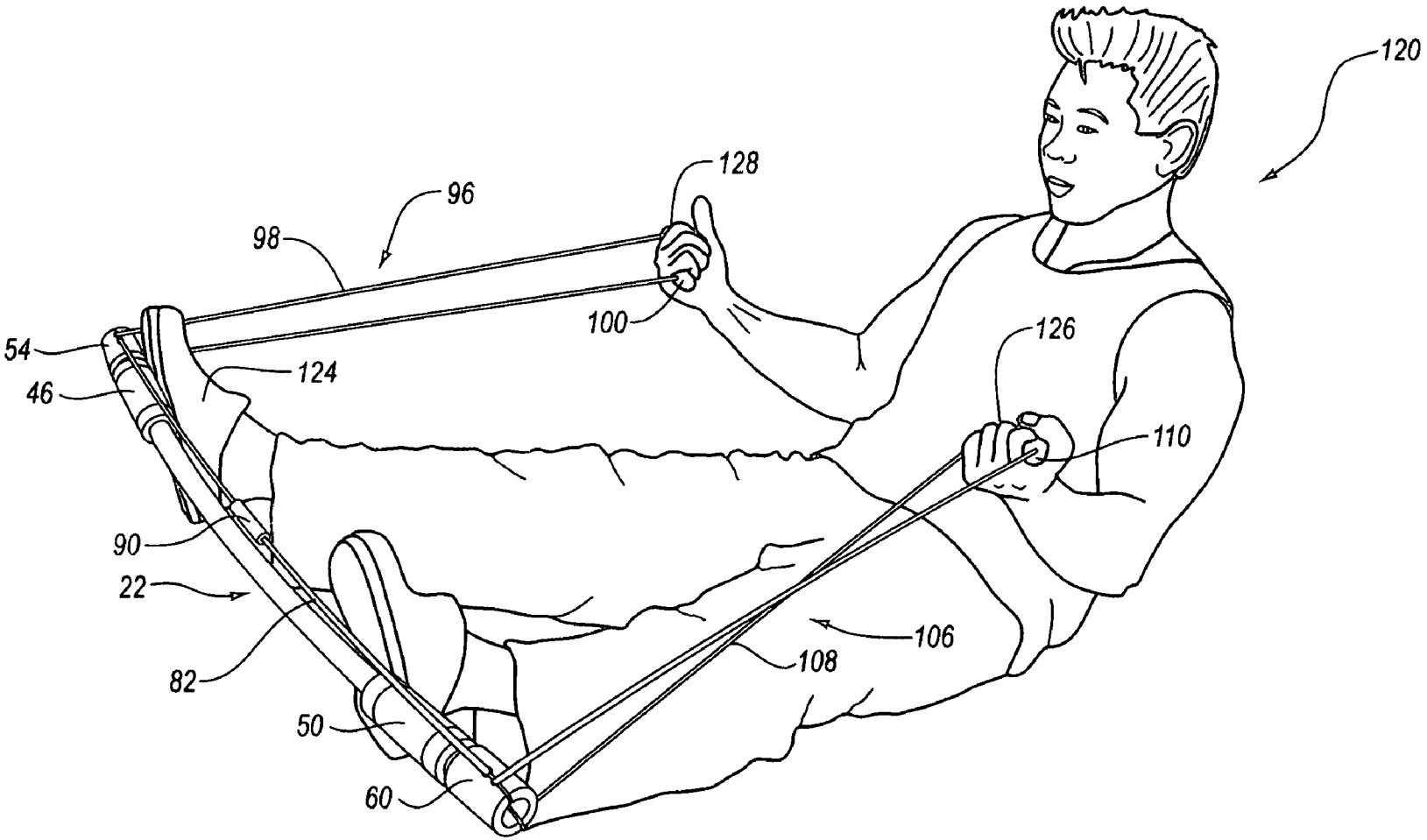
Figure 8:
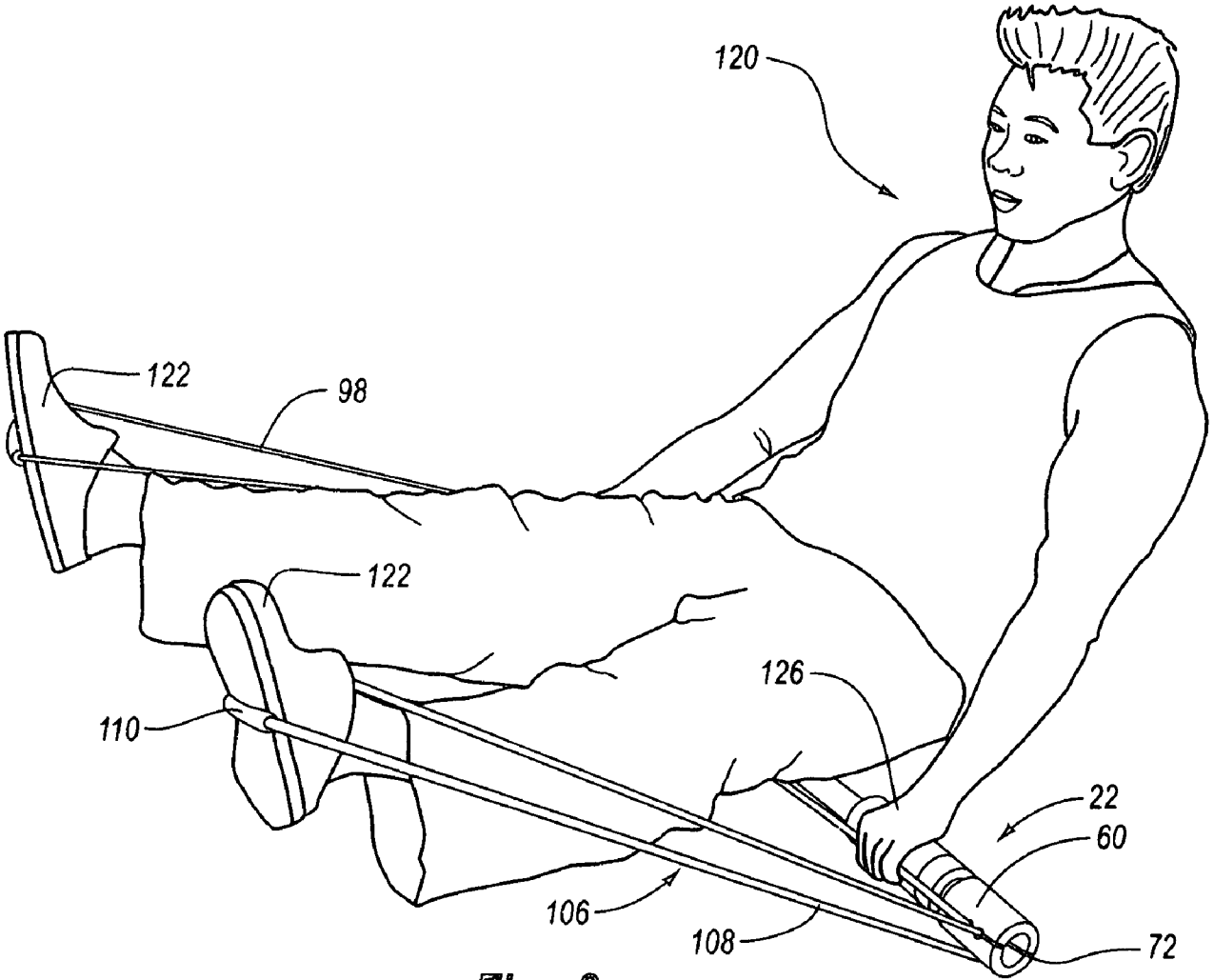
Figure 9:
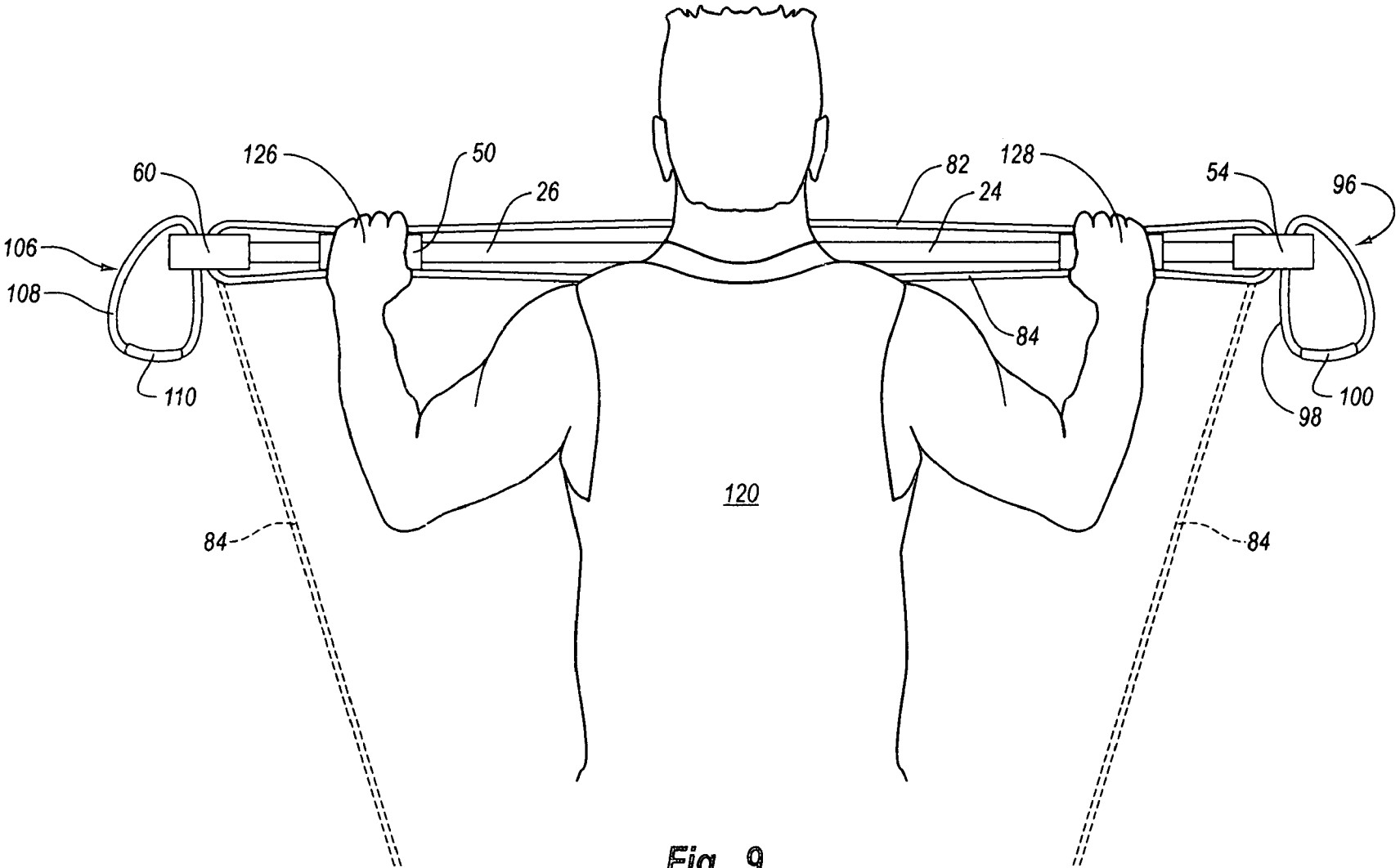
Figure 10:
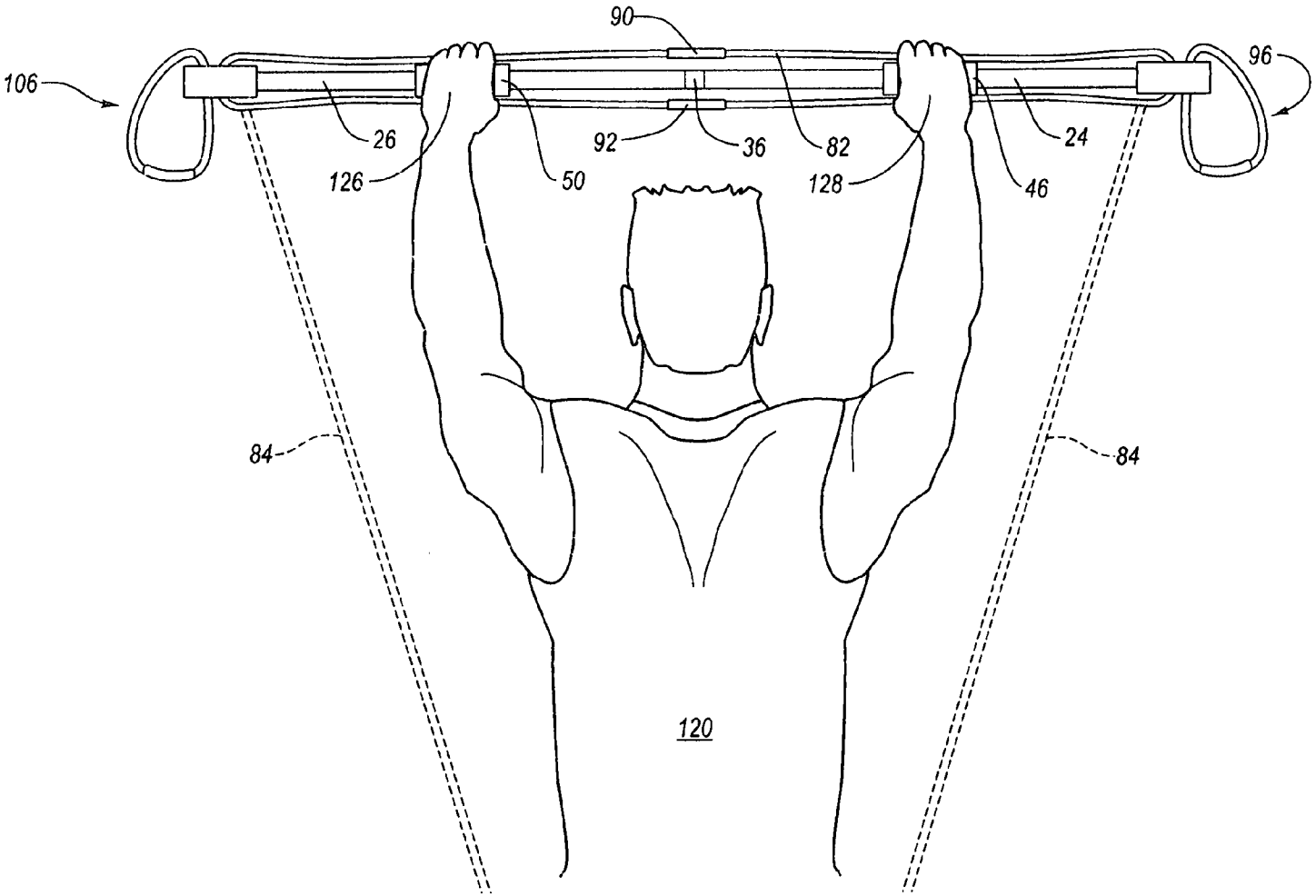
Figure 11:
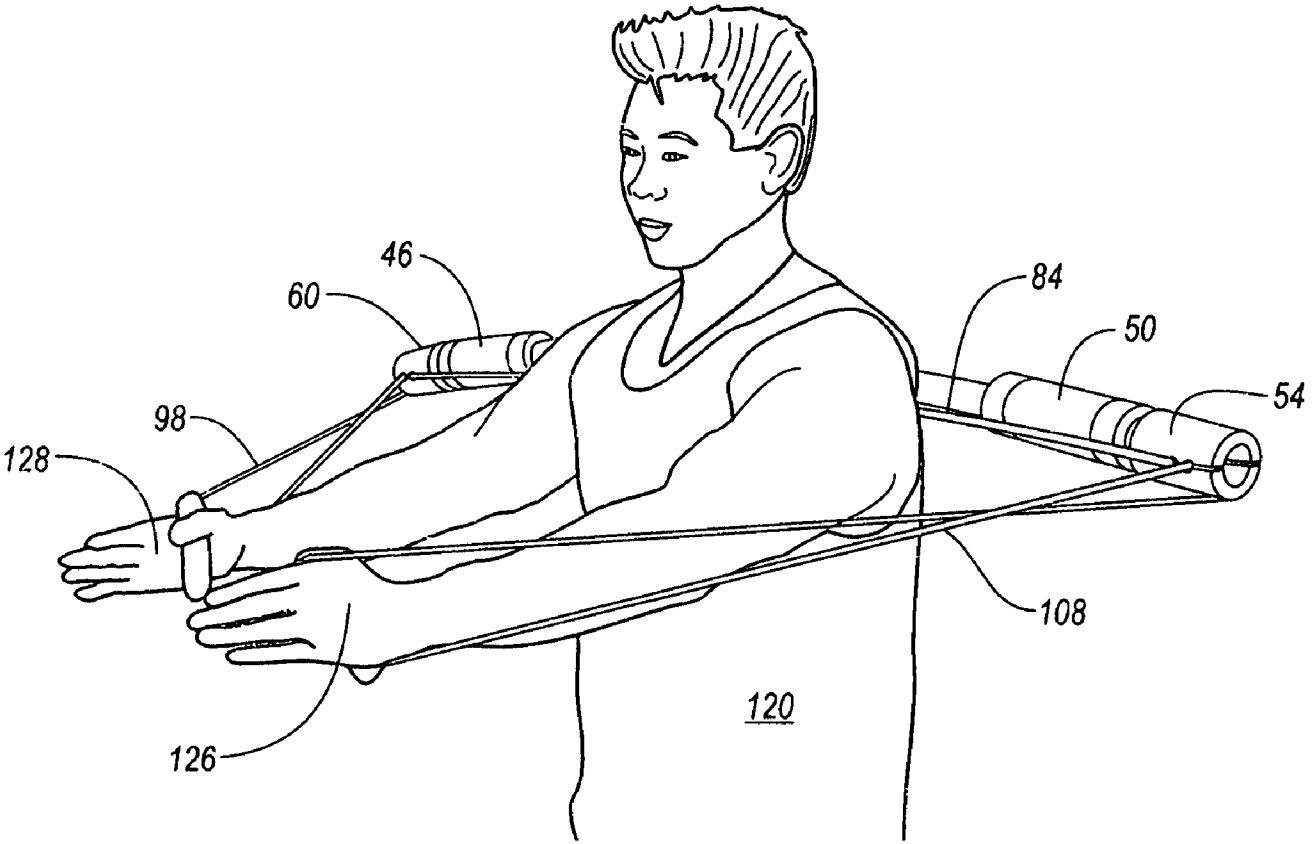

FIG. 3, a side elevation view of the exercise apparatus;

FIG. 4, a view like that of FIG. 3, but showing the long stretch band pulled away from opposite sides of the staff;

FIG. 5, a view like that of FIG. 3, but showing the sleeve-sliders positioned closer to the center point of the staff;

FIG. 6, a view like that of FIGS. 3 and 5, but showing the sleeve-sliders in a position;

FIG. 7, a pictorial view showing a user performing a exercise, using the exercise apparatus of the invention;

FIG. 8, a view like that of FIG. 7, but showing the user performing a different exercise;

FIG. 9, a view like that of FIG. 7, but showing a user performing another exercise;

FIG. 10, another view like that of FIG. 7, but showing the user performing yet another exercise;

FIG. 11, a view like that of FIG. 7, but showing the user performing still another exercise with the exercise apparatus of the invention.

Figure 12:
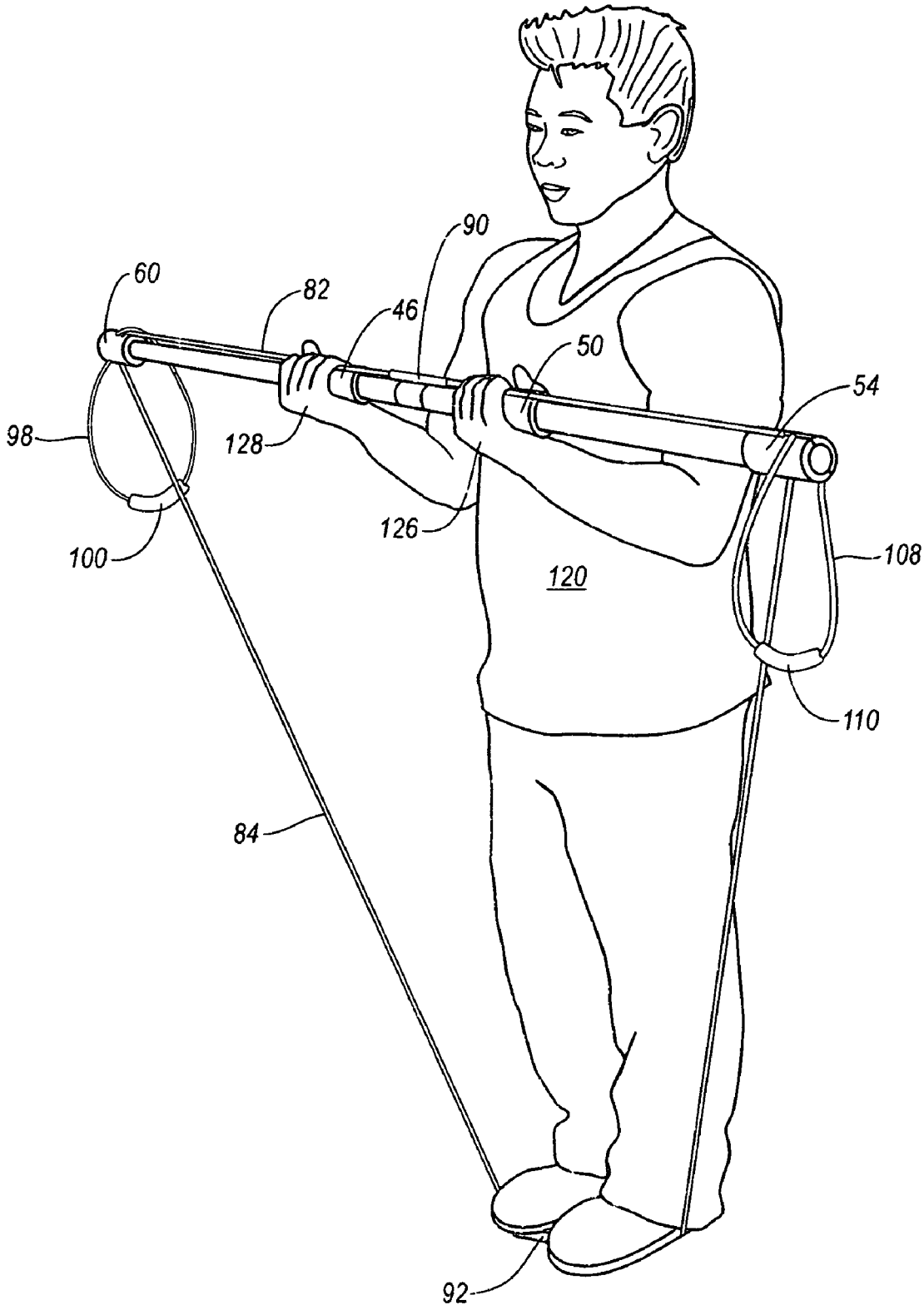
Figure 13:
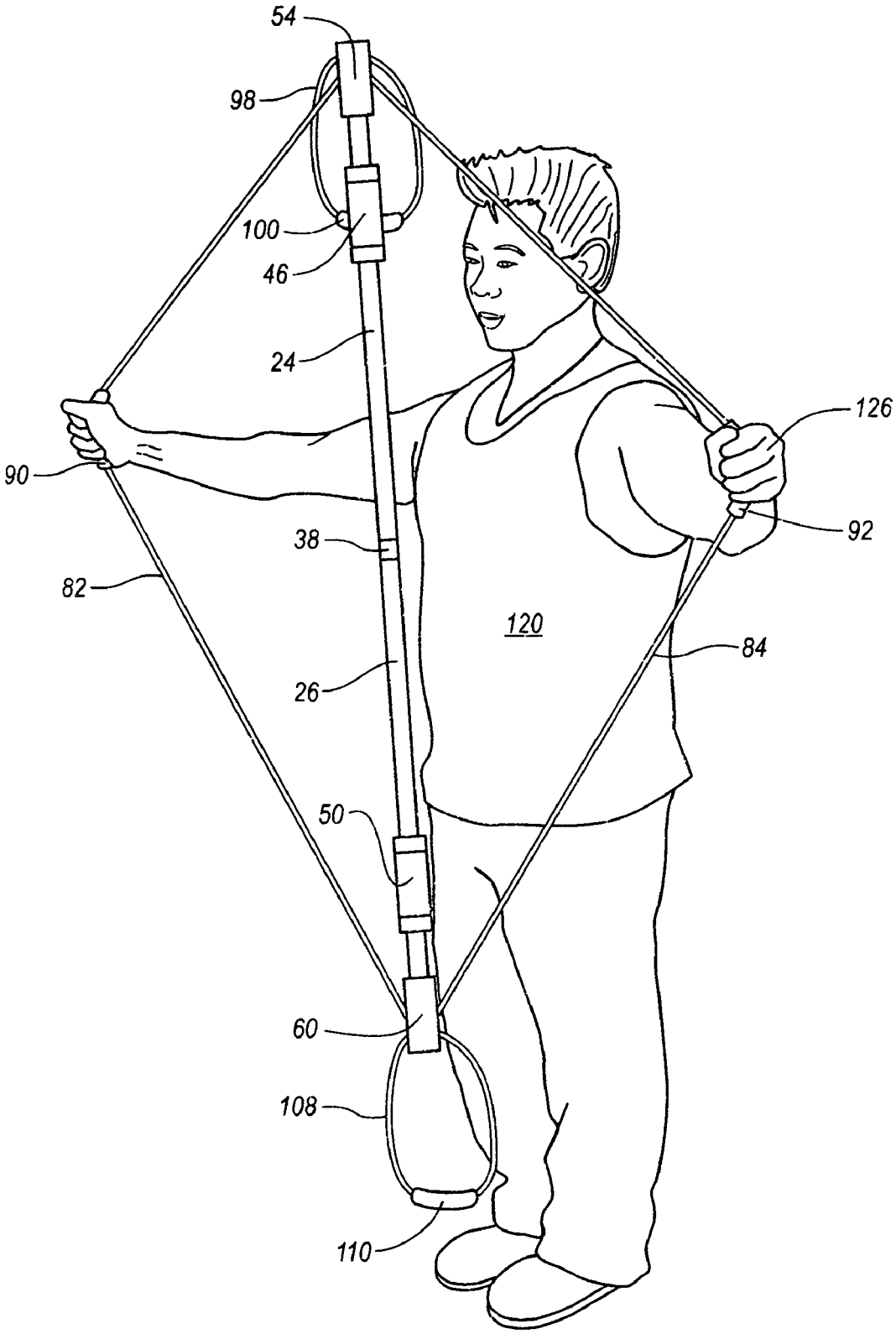

FIG. 12, a pictorial view showing the user performing another exercise with the exercise apparatus of the invention; and FIG. 13, a pictorial view showing the user performing still another exercise with the exercise apparatus of the invention.

DETAILED DESCRIPTION

Referring Now the Drawings

The exercise apparatus 20 of the invention includes a staff 22 formed from a pair of straight, rigid limbs 24 and 26.

Limb 24 is tubular and includes a non-threaded end 28 and an exteriorly threaded end 30. Similarly, limb 26 is tubular and includes a non-threaded end 32 and an exteriorly threaded end 34.

Limbs 24 and 26 are connected end-to-end axially together with a coupler 36. Coupler 36 is tubular and has am outer diameter to just tightly fit into the open ends 28 and 32 of the limbs 24 and 26, respectively. A central collar 38 is formed on, or affixed to, the coupler 36, intermediate the length of the coupler. In assembling the limbs 24 and 26 to form the staff 22, the end 40 of coupler 36 is inserted into the end 28 of limb 24. The end 32 of limb 26 is telescoped onto the end 42 of coupler 36. The limbs 24 and 26 are pushed into engagement with collar 38.

A sleeve-slider 46 has a bore 48 therethrough. Bore 48 has an inside diameter that is just larger than the exterior diameter of limb 24. Sleeve-slider 46 telescopes over threaded end 30 of the limb 24 and onto limb 24.

Similarly, a sleeve-slider 50 has a bore 52 therethrough that has an inside diameter that is just larger than the outside diameter of limb 26. Sleeve-slider 50 telescopes over threaded end 34 of limb 26 and onto limb 26.

An end cap 54 has a bore 56 therethrough and bore 56 is interiorly threaded at one end 58 so that the end cap will thread onto threaded end 30 of limb 24. The other end 59 of end cap 54 is non-threaded.

Another end cap 60 has a bore 62 therethrough. Bore 62 is interiorly threaded at one end 64 to be threaded onto the threaded end 34 of limb 26. The other end 65 of end cap 60 is non-threaded.

Each end cap 54 and 60 has a pair of axially spaced holes 68 and 70. Each hole 68 and 70 extends fully through the end cap transverse to the axis of the staff 22. Each end cap 54 and 60 also has a narrow slot 72 extending from the non-threaded end 59 and 65, respectively, of the end caps into engagement with the holes at opposite sides of the end cap.

A long endless stretch band 80 formed of resilient tubing, i.e., surgical rubber tubing, has side lengths 82 and 84, and ends 86 and 88 interconnecting the side lengths. The overall length between ends of the long endless stretch band 80 is such that when the exercise apparatus 20 is assembled, the side lengths 82 and 84 and band 80 are lightly stretched between ends 86 and 88 such that the side lengths are close to the shaft and the sleeve-sliders 46 and 50.

Handles 90 and 92 are respectively formed around the mid-portions of the side lengths 82 and 84 to provide hand grips for a user, as will be further described.

A short endless stretch band 96 formed as an endless loop 98 and also made of a stretchable material such as surgical rubber tubing, has a handle 100 formed around a middle portion of loop 98 to be grasped by a user.

Similarly, a short endless stretch band 106 formed as an endless loop 108, made of stretchable material, such as surgical rubber tubing has a handle 110 formed around a middle portion of the loop 108 to be grasped by a user.

Figure 1:
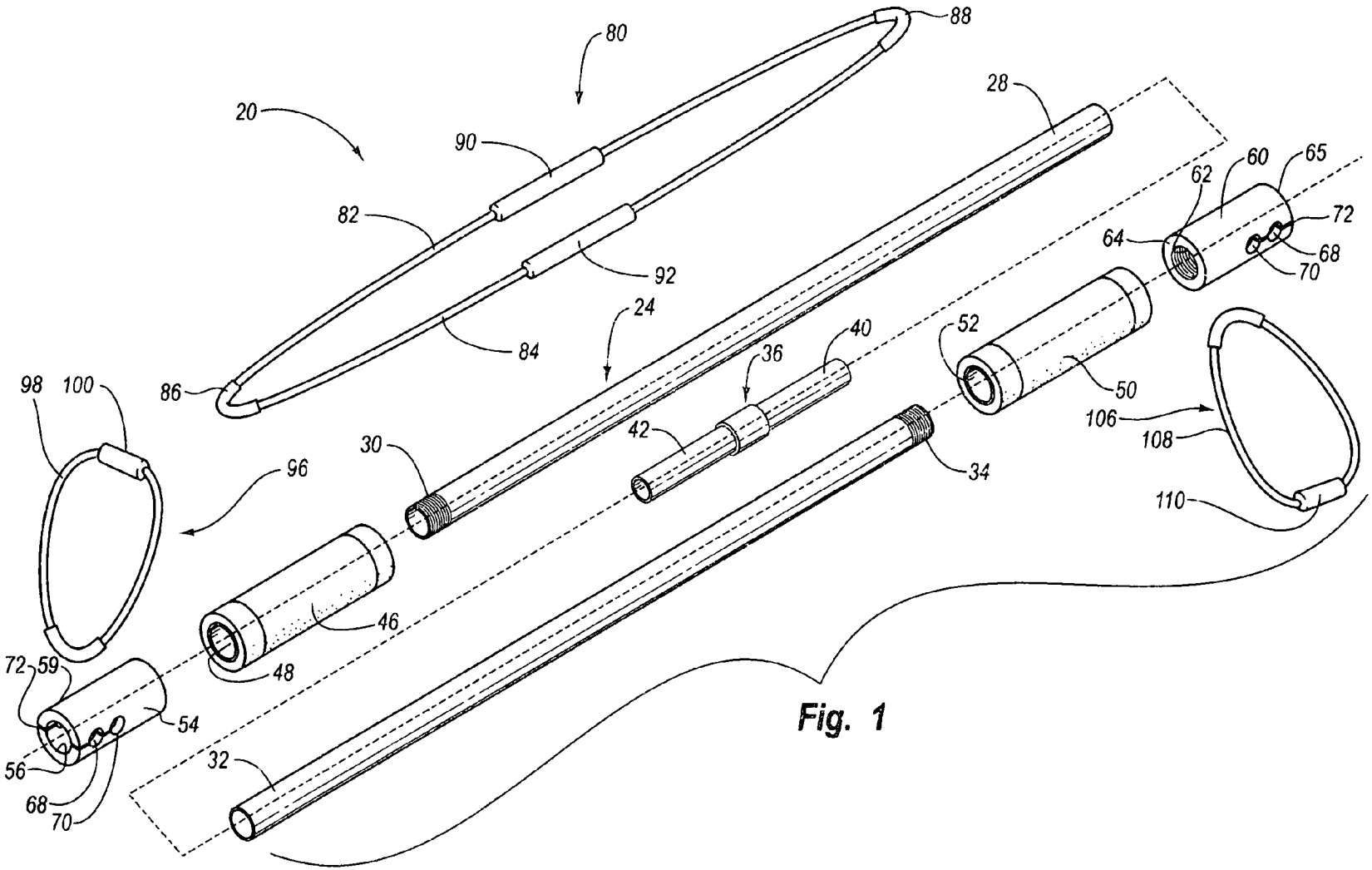
FIG. 1, is an exploded, perspective view of the components of the exercise apparatus of the invention.
Figure 2:
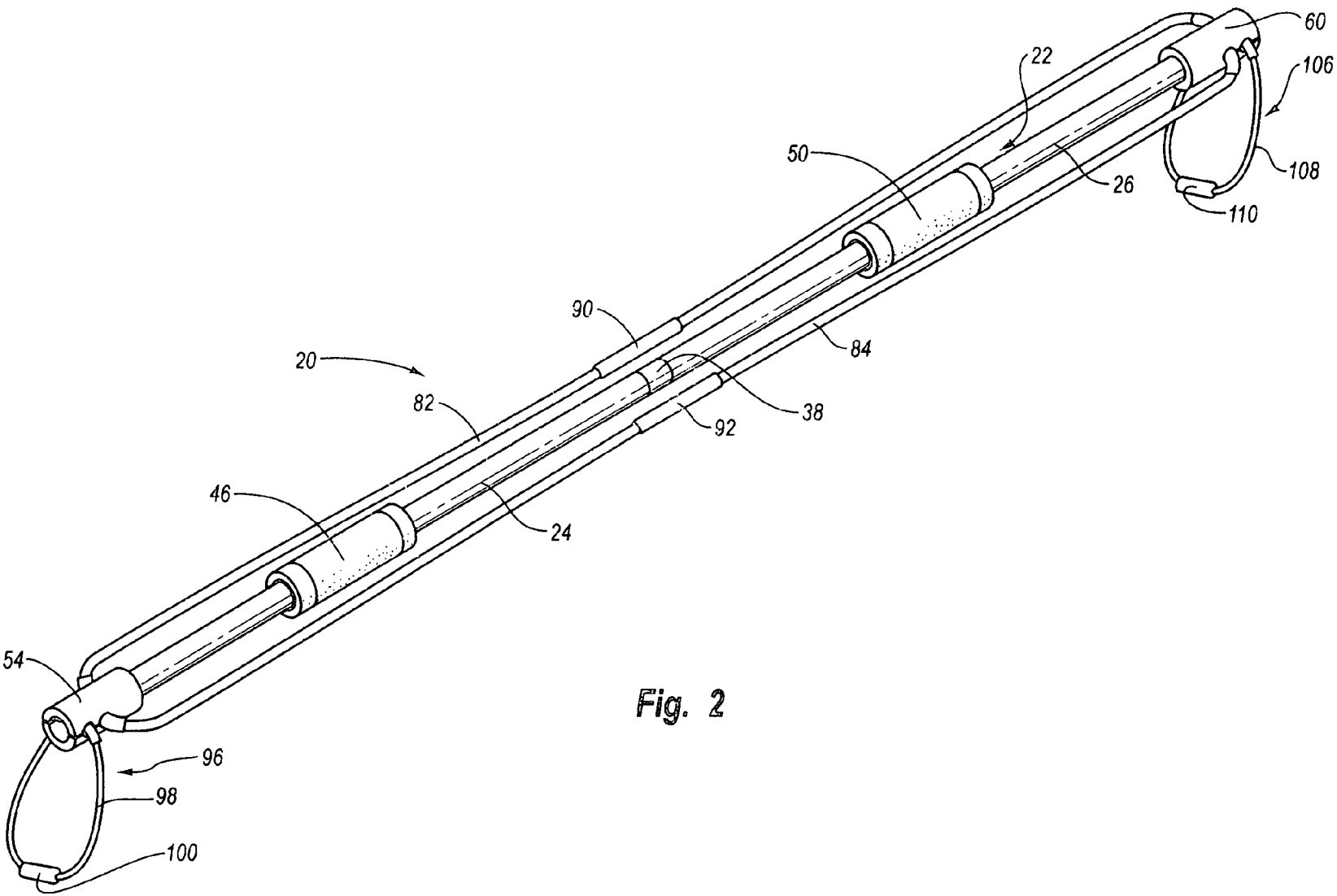
FIG. 2, is a perspective view of the exercise apparatus of the invention with the components assembled.

When disassembled, the exercise apparatus, as shown in FIG. 1, comprises small, lightweight components that can easily be carried by a user. A carry bag, not shown, may be used to hold the components together for storage and transport.

The most bulky components used to make the exercise apparatus are the limbs 24 and 26, which may each have a length of, for example, between about thirty-five and forty-five cm. When assembled as staff 22, to include end caps 54 end 60, the overall length of between eighty and one-hundred cm allows the staff to best function as necessary when the bands are stretched and/or pulled from the end caps during performance of exercises. The limbs 24 and 26 are preferably made of aluminum, plastic or other suitable lightweight material that will not bend or break during use of the exercise apparatus 20.

Typical exercises that can be performed using the exercise apparatus 20 are shown in FIGS. 4 and 7-13.

FIGS. 4 and 13 show that in use of the exercise apparatus 20, the side lengths 82 and 84 of the long stretch band 80 can be simultaneously spread outwardly from opposite sides of the staff 22. The side lengths 82 and 84 are stretched outwardly, in opposite directions, using handles 90 and 92 and are then relaxed. The stretching and relaxing can be accomplished while a user is reclining, sitting, or standing and the staff 22 floats and is not anchored.

As shown in FIG. 7, a user 120 in a sitting position can place the staff 22 against the bottom of his feet 122 to secure the staff in place. The short endless stretch bands 96 and 106 are stretched by a user 120 grasping handles 100 and 110 in his hands 126 and 128 and pulling and relaxing the bands simultaneously, or in sequence.

Another typical exercise performed by a user with exercise apparatus 20 is shown in FIG. 8. As shown, the user sits on the staff 22, places short stretch bands 96 and 106 over feet 122 so that the user can spread, push or otherwise stretch and relax the short stretch bands 96 and 106 simultaneously, or in sequence, using his legs.

FIGS. 9, 10 and 12 show use of the exercise apparatus 20 being raised and lowered in front of the user (FIG. 9), and above the head of the user (FIG. 10). The exercise apparatus can thus be used as a dead weight to perform some exercises. Alternatively, as shown in FIGS. 9, 10 and 12, the user can stand on the side length 84 and then raise and lower the staff 22 between a lowered position and an overhead raised position (FIG. 10), and a raised position in front of his body (FIGS. 9 and 12). It will be apparent that while the exercises of FIGS. 9, 10 and 12 show lifting of the staff 22 in front of the user, that lifts behind the user's head can also be performed. It will also be apparent that the user can change the exercises by choosing to use either an overhead grip or an underhand grip.

FIG. 11 shows still another typical exercise that can be performed with the exercise apparatus 20. As shown, the staff 22 is positioned behind the shoulders of a user. The user 120 grasps handles 100 and 110 and moves his arms and hands 126 and 128 to stretch the bands 96 and 106.

Also, as shown in FIGS. 9, 10 and 12, the user can while the staff is positioned in front, above, or behind his body, grasp the sleeve-sliders 46 and 50, together with the side lengths 82 and 84 of long stretch band 80 lying alongside the staff and sleeve-sliders. Then, either while lifting and lowering the staff 22, or while holding the staff at a desired height, the sleeve-sliders 46 and 50 are moved forward or away from one another. Such movement of the sleeve-sliders, while stretching the portions of the long resilient band side lengths between the end caps and the sleeve-sliders, or the portions of the slide lengths 82 and 84 between sleeve-sliders exercises the arms and upper body muscles of the user.

The user 120 shown in FIG. 12 is standing on the side length 84 of the long resilient, endless stretch band 80 while grasping the sleeve-sliders 46 and 50, and the side length 82. The user is thus able to exercise by lifting against the stretch of side length 84 and, at the same time, to exercise muscle of the hands, arms and upper body by moving the sleeve-sliders along the staff 22, while grasping the sleeve-sliders and the side length 82 with an underhand grip.

The exercises shown herein are typical of, but are not in any way limiting, of exercises that can be performed using exercise apparatus 20.

As previously noted, the exercise apparatus 20 is lightweight, and easily assembled for use, with stretch band 80. The band 80 is stretched at its ends 86 and 88 until the ends are stretched thin enough to fit through slots 72 and into the end caps 54 and 60 until the long stretch band extends out of the holes 70 through both end caps 46 and 50. While only one long stretch band 20 is shown, it will be apparent that more than one such band can be provided to provide additional resistance during exercising if desired.

Short bands 96 and 106 are similarly stretched until the band portions opposite handles 100 and 110 are thin enough to slide through slots 72 to allow the short bands to extend through a hole 68 provided in each of the end caps 54 and 68.

The exercise apparatus 20 does not require any tools in the assembly or disassembly of the apparatus.

Although a preferred embodiment of my invention has been herein described, it is to be understood that the present disclosure is by way of example and that variations are possible without departing from the subject matter coming within the scope of the following claims, which subject matter I regard as my invention.

I claim:

1. An exercise apparatus comprising
a rigid staff formed from rigid limbs connected end-to-end;
an end cap on each opposite end of said staff;
a long resilient endless band stretched between said end caps; and
a short resilient endless band attached to each of said end caps.

2. An exercise apparatus as in claim 1, wherein
each end cap has a first hole therethrough, said hole extending transverse to the axis of said end caps and said rigid staff;
a slot formed in the end of each said end cap remote from the staff attached thereto, said slot extending through the end cap transverse to the axis of the staff and into the first hole; and wherein
the long resilient endless band is stretched and passed through the slot and into said first hole of each said end cap.

3. An exercise apparatus as in claim 2, further including
a second hole through each said end cap and engaging the slot formed in said end cap; and wherein
each short resilient band is passed through a said second hole.

4. An exercise apparatus as in claim 3, further including
handles formed centrally of side lengths of the long resilient endless band.

5. An exercise apparatus as in claim 4, further including handles formed on each of the short resilient endless bands.

6. An exercise apparatus as in claim 1,wherein
the rigid staff has a length of between eighty cm and one-hundred cm.

7. An exercise apparatus comprising
a rigid staff;
an end cap on each opposite end of said staff;
a long resilient endless band stretched between said end caps;
a short resilient endless band attached to each of said end caps; and
a pair of spaced apart sleeve-sliders movable on the staff and movable towards and away from one another.

8. An exercise apparatus as in claim 7, wherein the sleeve-sliders are telescoped on and are slidable along the staff.

9. An exercise apparatus as in claim 8, wherein the long resilient endless band has side lengths extending alongside the staff between the ends of said staff and alongside the sleeve-sliders.

10. An exercise apparatus as in claim 9, wherein
each end cap has a first hole therethrough, said hole extending transverse to the axis of said end caps and said rigid staff;
a slot formed in the end of each said end cap remote from the
staff attached thereto, said slot extending through the end cap transverse to the axis of the staff and into the first hole; and wherein
the long resilient endless band is stretched and passed through said first hole of each said end cap.

11. An exercise apparatus as in claim 10, further including
a second hole through each said end cap and engaging the slot formed in said end cap; and wherein
each short resilient band is passed through a said second hole.

12. An exercise apparatus as in claim 11, further including
handles formed centrally of side lengths of the long resilient endless band.

13. An exercise apparatus as in claim 12, further including handles formed on each of the short resilient endless bands.

14. An exercise apparatus comprising
a long rigid shaft;
a long resilient cordless band stretched from end-to-end of said staff, said long resilient cordless band including a pair of side lengths extending alongside said staff and ends interconnecting opposite ends of said side lengths at opposite ends of said shaft; and
a pair of spaced apart grasping means reciprocably movable along said shaft towards and away from one another, each said means having said side lengths extending close thereto, whereby at least one said side length can be grasped during reciprocable movement of the said spaced apart grasping means along said shaft.

15. An exercise apparatus as in claim 14, wherein
the rigid staff is formed from rigid limbs connected end-to-end.

16. An exercise apparatus as in claim 14, wherein
said rigid staff includes an end cap on the end of each limb remote from the end-to-end connection of said limbs.

17. An exercise apparatus as in claim 16, wherein
each end cap has a first hole therethrough, said hole extending transverse to the axis of said end caps and said rigid staff;

a slot formed in the end of each said end cap remote from the limb attached thereto, said slot extending through the end cap transverse to the axis of the limb and into the first hole; and wherein the long resilient endless band is stretched and passed through said first hole of each said end cap.

18. An exercise apparatus as in claim 17, further including a second hole through each said end cap and engaging the slot formed in said end cap; and wherein each short resilient band is passed through a said second hole.

19. An exercise apparatus as in claim 18, further including handles formed centrally of side lengths of the long resilient endless band.

20. An exercise apparatus as in claim 19, further including handles formed on each of the short resilient endless bands.

21. An exercise apparatus comprising a rigid staff;

an end cap on each opposite end of said staff;

a long resilient endless band stretched between said end caps with opposite ends of said long resilient endless band secured to said end caps on said rigid staff and the lengths of said long resilient band between said opposite ends of said long resilient endless band extending alongside the longitudinal length of said rigid staff;

a short resilient band attached one of said end caps; and another short resilient band attached to the other of said end caps.

22. An exercise apparatus as in claim 21, wherein the rigid staff is formed from rigid limbs connected end-to-end.

* * * * *